US007126540B2

(12) United States Patent
Hsu et al.

(10) Patent No.: US 7,126,540 B2
(45) Date of Patent: Oct. 24, 2006

(54) DIPOLE ANTENNA

(75) Inventors: De-Fu Hsu, Hsinchu (TW); Wen-Man Huang, Hsinchu (TW); Hsiao-Ting Huang, Hsinchu (TW)

(73) Assignee: Z-Com Inc., Hsinchu (TW)

( * ) Notice: Subject to any disclaimer, the term of this patent is extended or adjusted under 35 U.S.C. 154(b) by 6 days.

(21) Appl. No.: 10/999,929

(22) Filed: Dec. 1, 2004

(65) Prior Publication Data

US 2006/0114167 A1 Jun. 1, 2006

(51) Int. Cl.
*H01Q 1/38* (2006.01)
*H01Q 9/16* (2006.01)
*H01Q 1/12* (2006.01)

(52) U.S. Cl. ..... 343/700 MS; 343/793; 343/718

(58) Field of Classification Search ..... 343/718, 343/793, 700 MS
See application file for complete search history.

(56) References Cited

U.S. PATENT DOCUMENTS

| | | | | |
|---|---|---|---|---|
| 6,166,694 | A * | 12/2000 | Ying | 343/702 |
| 6,337,666 | B1 * | 1/2002 | Bishop | 343/795 |
| 6,424,309 | B1 * | 7/2002 | Johnston et al. | 343/767 |
| 6,621,464 | B1 * | 9/2003 | Fang et al. | 343/795 |
| 6,674,409 | B1 * | 1/2004 | Cheah | 343/795 |
| 6,753,814 | B1 * | 6/2004 | Killen et al. | 343/700 MS |
| 6,836,250 | B1 * | 12/2004 | Dai et al. | 343/700 MS |
| 6,975,278 | B1 * | 12/2005 | Song et al. | 343/795 |
| 2004/0140941 | A1 * | 7/2004 | Joy et al. | 343/795 |

* cited by examiner

*Primary Examiner*—Don Wong
*Assistant Examiner*—Marie Antoinette Cabucos
(74) *Attorney, Agent, or Firm*—Foley & Lardner LLP

(57) ABSTRACT

A dipole antenna includes a board and a dipole element. The board includes a dielectric substrate. The dipole element resonates within a predetermined bandwidth, and includes a pair of bilaterally symmetrical radiating arms, each of which is formed on the dielectric substrate. The dipole antenna has a relatively high degree of omni-directivity.

12 Claims, 12 Drawing Sheets

DIPOLE ANTENNA

BACKGROUND OF THE INVENTION

1. Field of the Invention

The invention relates to an antenna, more particularly to a dipole antenna that is formed on a dielectric substrate.

2. Description of the Related Art

Conventional omni-directional printed circuit board (PCB) based antennas, such as a planar inverted-Fantenna (PIFA) and a patch antenna, have an unsatisfactory omni-directivity.

It is desirable to provide a PCB-based antenna that has a relatively high degree of omni-directivity.

SUMMARY OF THE INVENTION

Therefore, the object of the present invention is to provide a dipole antenna that is capable of overcoming the aforesaid drawback of the prior art.

According to the present invention, a dipole antenna comprises a board that includes a dielectric substrate, and a dipole element that resonates within a predetermined bandwidth, and that includes a pair of radiating arms, each of which is formed on the dielectric substrate.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
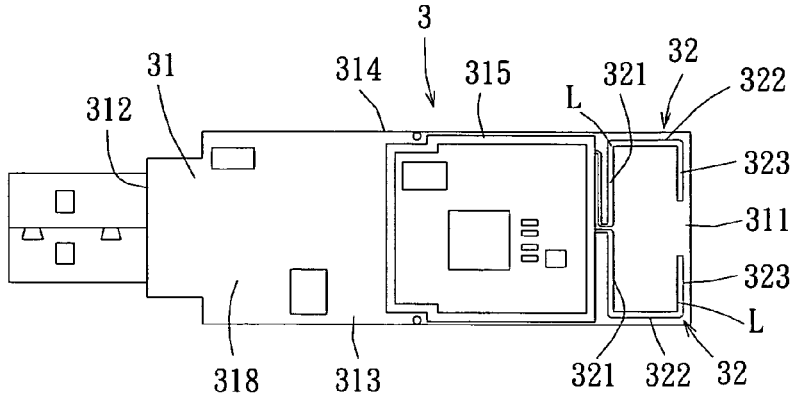
FIG. 1 is a schematic view of the first preferred embodiment of a dipole antenna according to the present invention.

Before the present invention is described in greater detail, it should be noted that like elements are denoted by the same reference numerals throughout the disclosure.

Referring to FIG. 1, the first preferred embodiment of a dipole antenna according to this invention is shown to include a board 3 and a dipole element.

The dipole antenna of this embodiment is implemented on a wireless network card that includes the board 3.

The board 3 includes a dielectric substrate 31 that has a first surface 318. The first surface 318 of the dielectric substrate 31 is generally rectangular in shape, and has first and second longer edges 313, 314, and first and second shorter edges 311, 312. In this embodiment, the board 3 is a printed circuit board, preferably, a FR-4 printed circuit board. Moreover, the dielectric substrate 31 has a dielectric constant in the range of 4.2 to 4.7.

The dipole element includes a pair of bilaterally symmetrical radiating arms 32, each of which is formed, by printing, on the first surface 318 of the dielectric substrate 31 of the board 3. In particular, each of the radiating arms 32 of the dipole element includes first, second, and third strips 321, 322, 323. The first strip 321 of each of the radiating arms 32 extends in a first direction, and has first and second ends that are respectively proximate to and distal from the other one of the radiating arms 32. The first ends of the first strips 321 are coupled to a transmission line 315. The second strip 322 of each of the radiating arms 32 extends in a second direction transverse to the first direction, and has a first end connected to the second end of the first strip 321 of a respective one of the radiating arms 32, and a second end. The third strip 323 of each of the radiating arms 32 extends in the first direction, and has first and second ends that are respectively proximate to and distal from the other one of the radiating arms 32. The first end of each of the third strips 323 is connected to the second end of a respective one of the second strips 322. In this embodiment, the dipole element resonates within a predetermined bandwidth that is centered at 2.45 GHz. Moreover, the first strips 321 of the radiating arms 32 of the dipole element form a 180-degree angle therebetween. Further, the third strips 323 of the radiating arms 32 of the dipole element are disposed adjacent to the first shorter edge 311 of the first surface 318 of the dielectric substrate 31 of the board 3.

It is noted that the second shorter edge 312 of the first surface 318 of the dielectric substrate 31 of the board 3 is provided with a universal serial bus (USB) port.

The length (L) of each of the radiating arms 32 of the dipole element can be calculated from the formula:

$$L=\lambda/4\sqrt{\in} \tag{1}$$

where L is the length of each of the radiating arms 32 of the dipole element, $\lambda$ is the wavelength, and $\in$ is the dielectric constant of the dielectric substrate 31 of the board 3.

Accordingly, given a bandwidth, the length (L) of each of the radiating arms 32 may be reduced by choosing a dielectric substrate 31 with a high dielectric constant.

Figure 2:
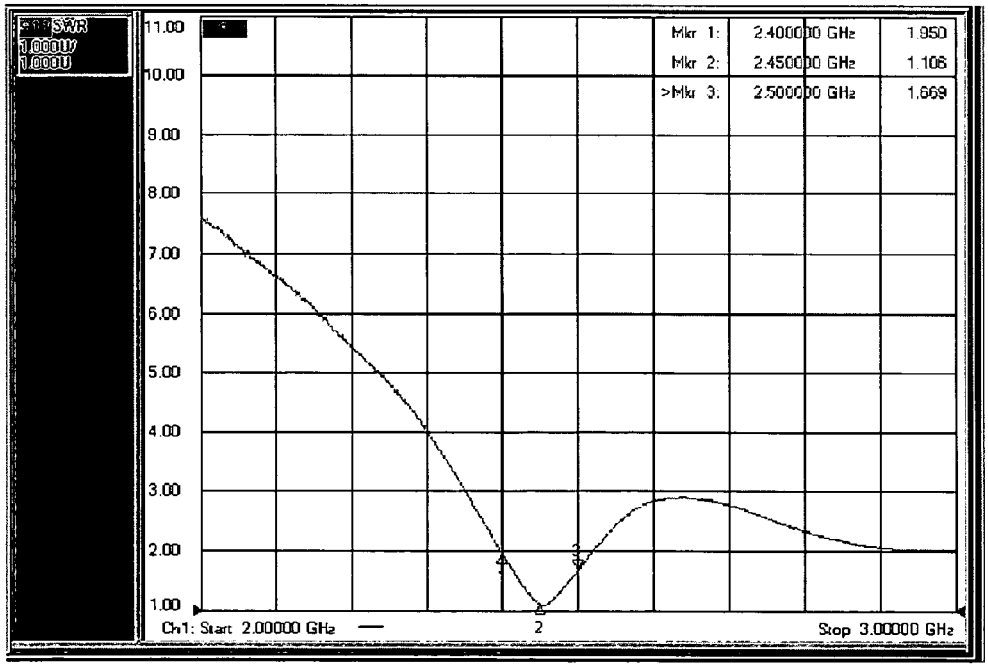
FIG. 2 is a graph illustrating a voltage standing wave ratio (VSWR) of the first preferred embodiment.
Figure 3:
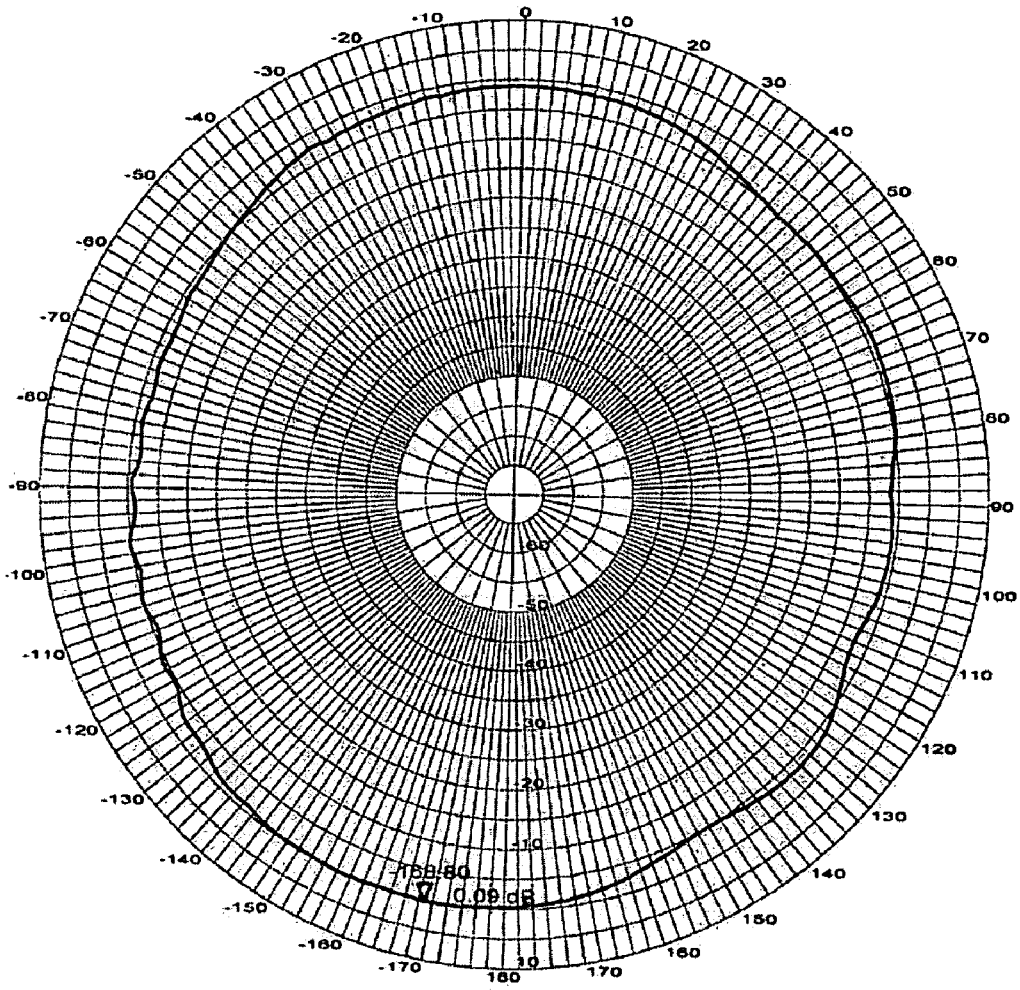
FIG. 3 is a graph illustrating a radiation pattern for horizontal polarization of the first preferred embodiment in the x-y plane.
Figure 4:
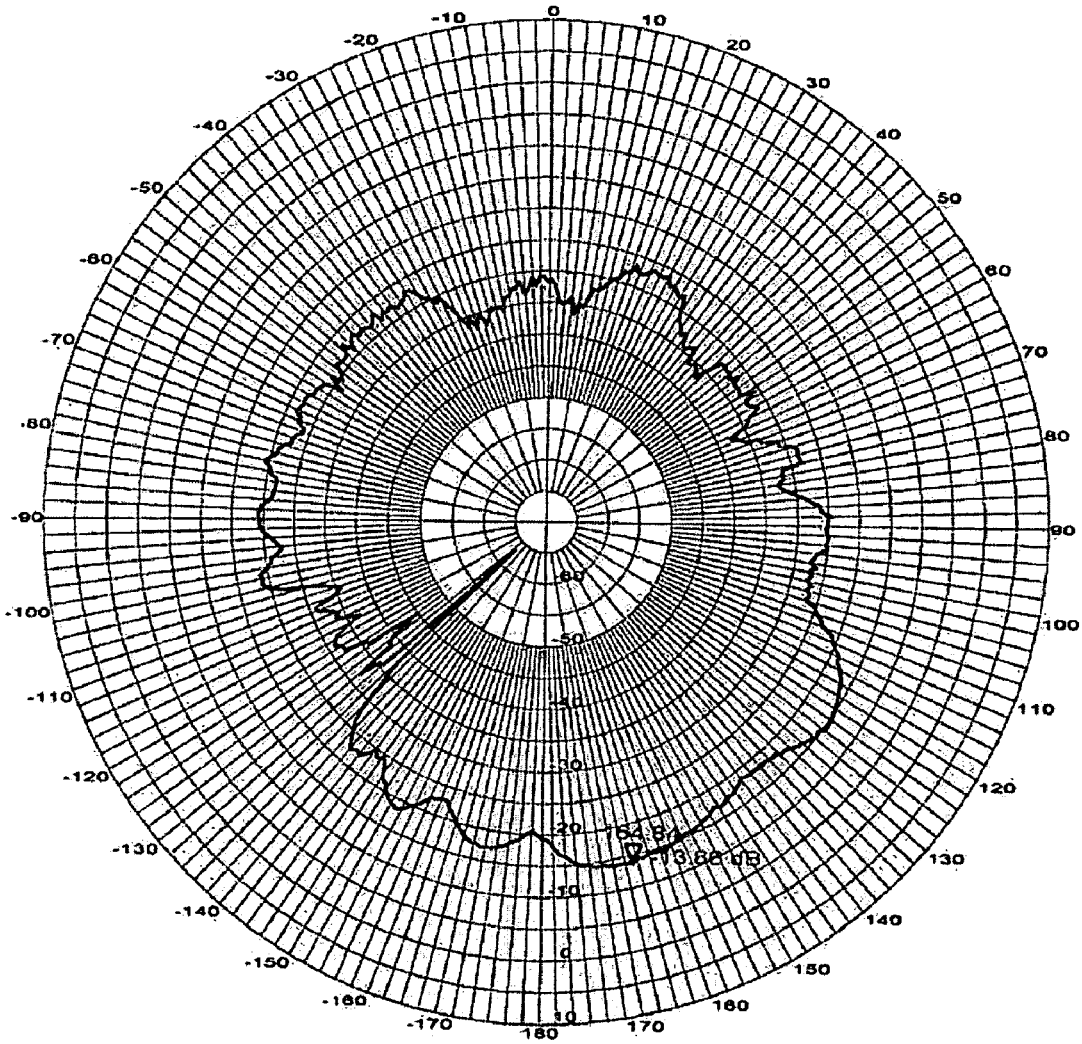
FIG. 4 is a graph illustrating a radiation pattern for vertical polarization of the first preferred embodiment in the x-y plane.
Figure 5:
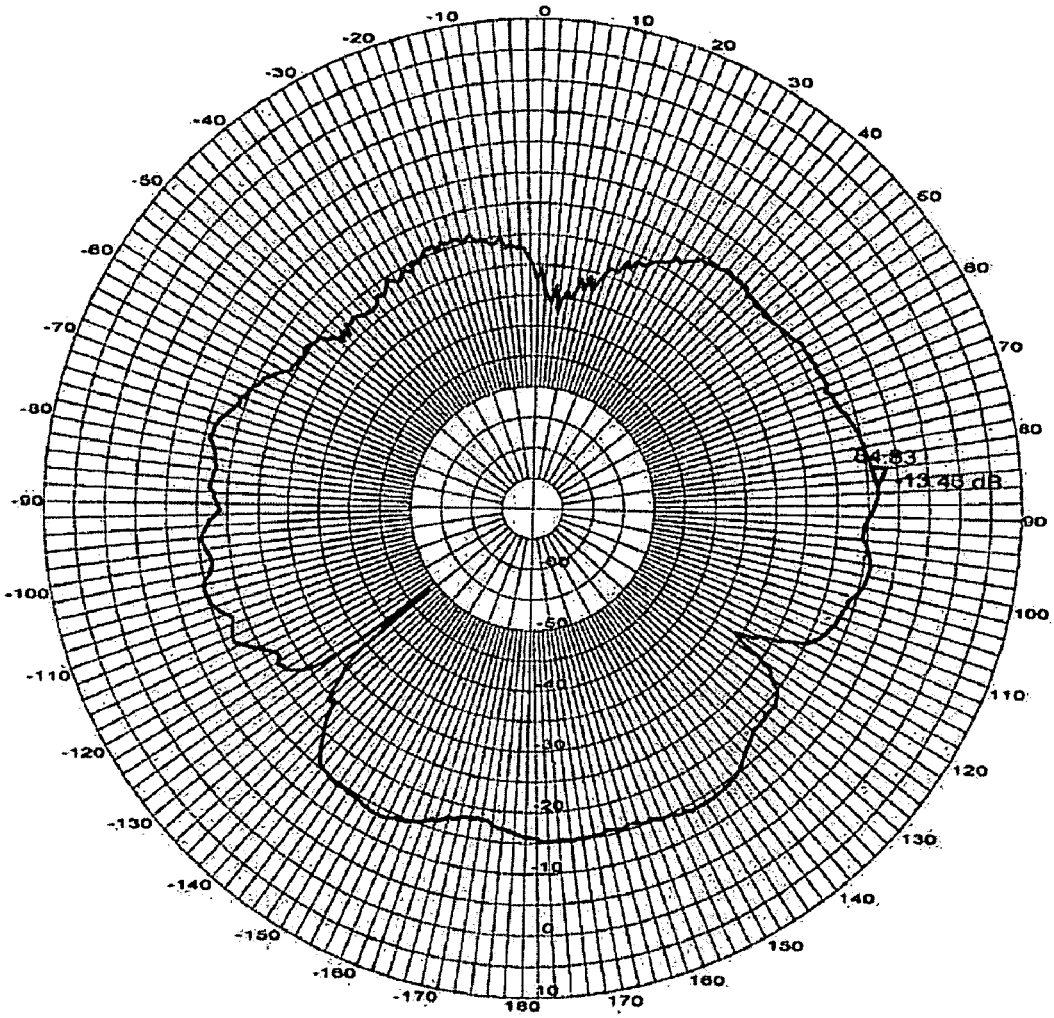
FIG. 5 is a graph illustrating a radiation pattern for horizontal polarization of the first preferred embodiment in the x-z plane.
Figure 6:
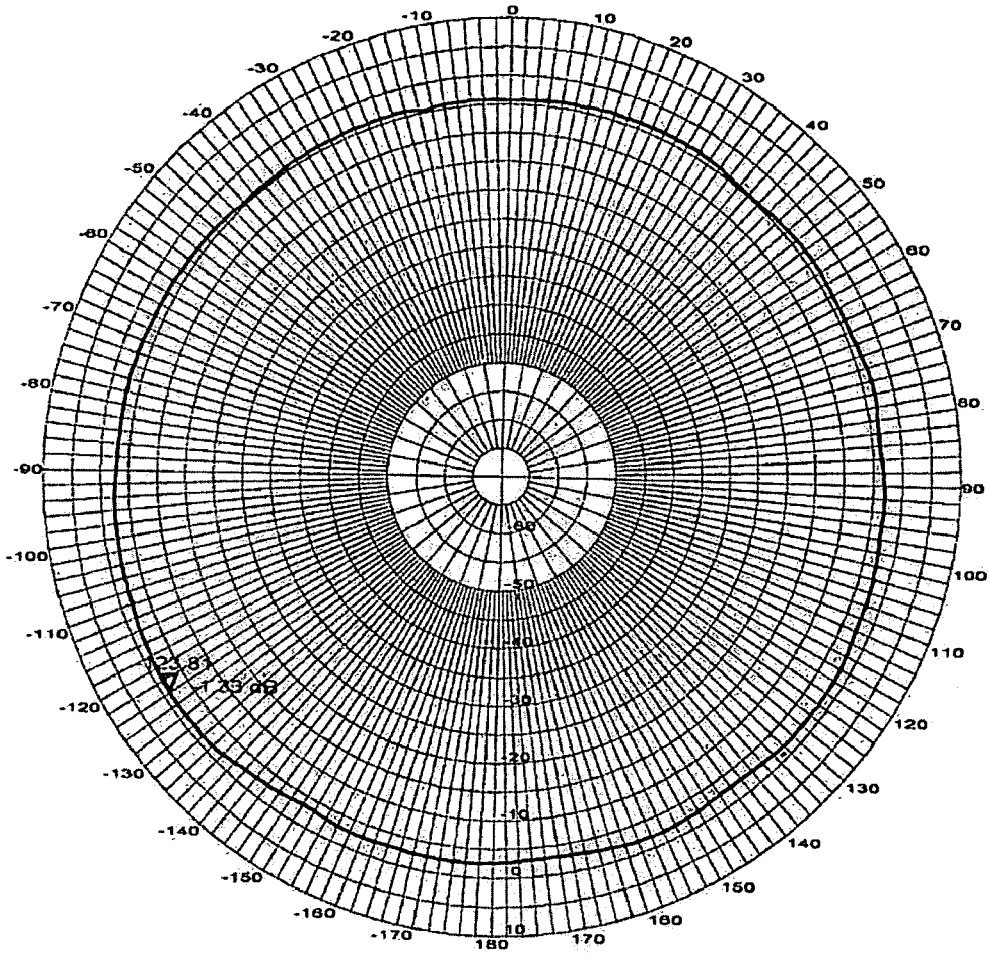
FIG. 6 is a graph illustrating a radiation pattern for vertical polarization of the first preferred embodiment in the x-z plane.
Figure 7:
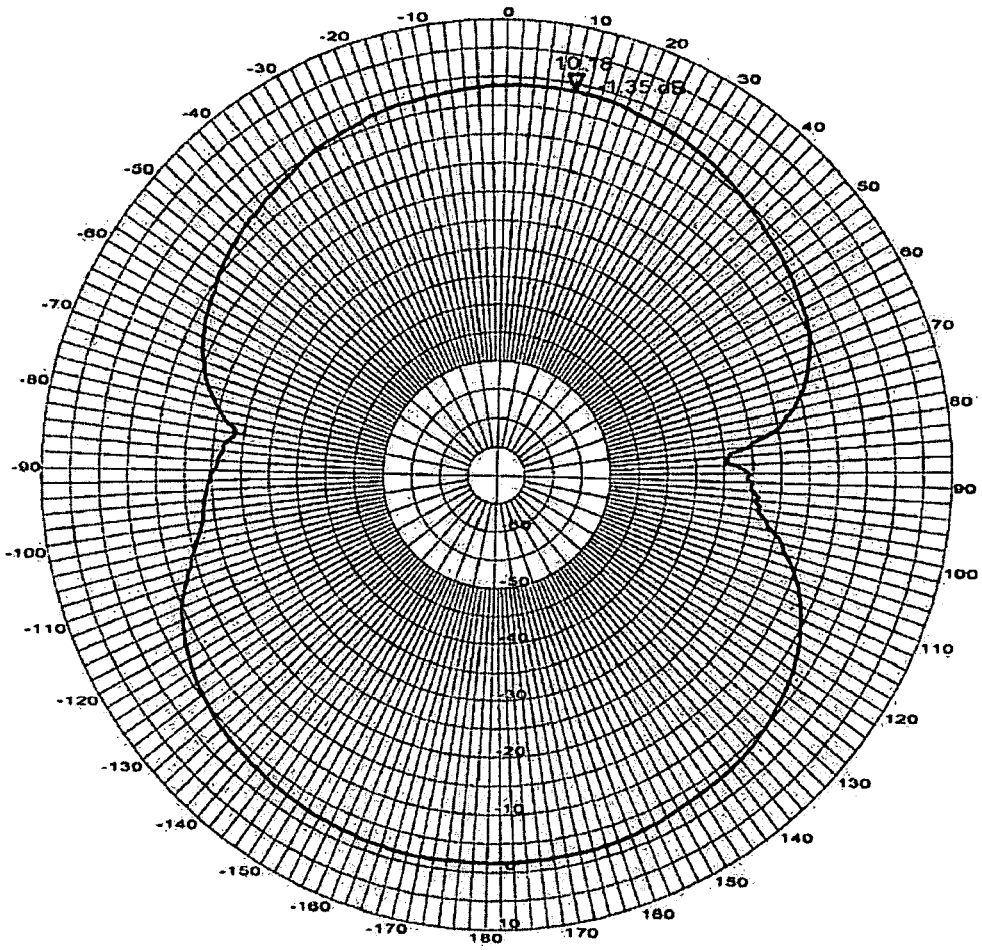
FIG. 7 is a graph illustrating a radiation pattern for horizontal polarization of the first preferred embodiment in the y-z plane.
Figure 8:
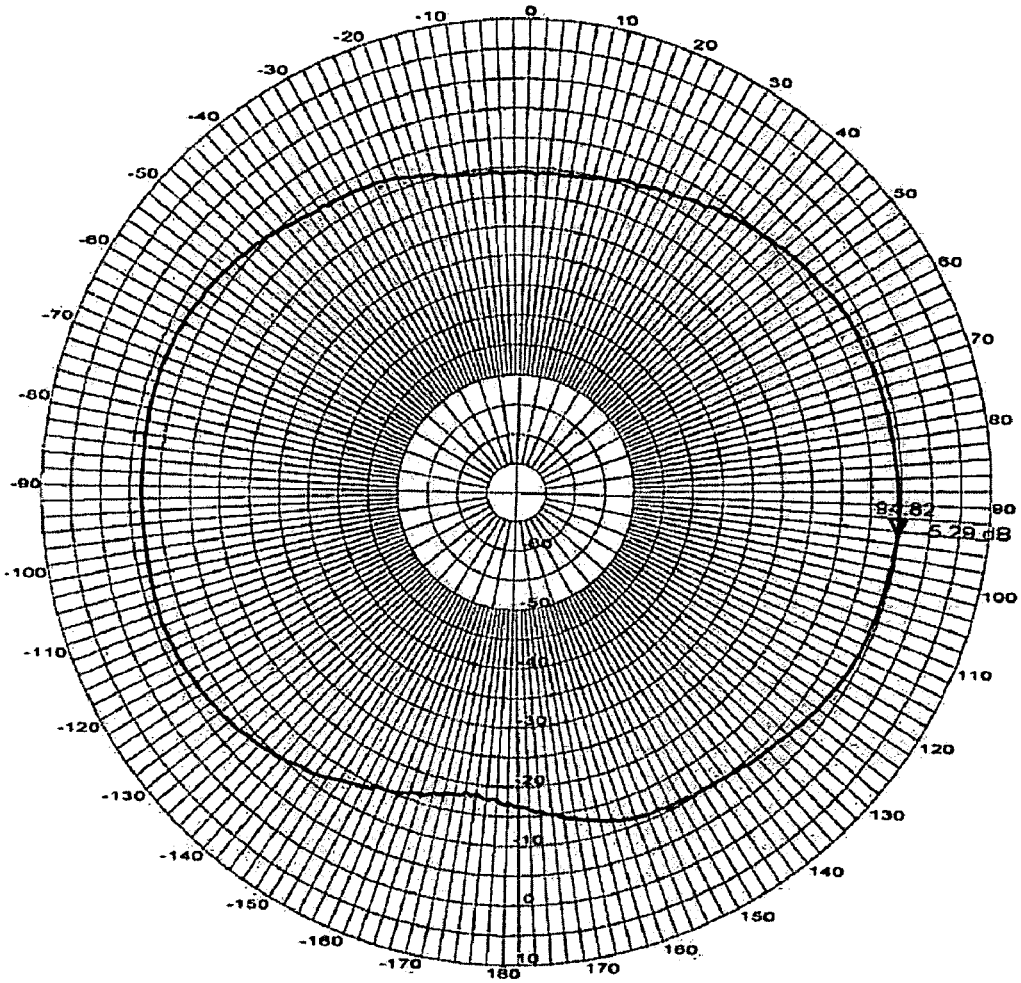
FIG. 8 is a graph illustrating a radiation pattern for vertical polarization of the first preferred embodiment in the y-z plane.

From an experimental result, as illustrated in FIG. 2, at the given predetermined bandwidth, the dipole antenna of this invention has a relatively low voltage standing wave ratio (VSWR), i.e., less than 2. Moreover, as illustrated in FIGS. 3 to 8, the radiation patterns for vertical and horizontal polarizations in x-y, x-z, and y-z planes of the dipole antenna of this invention are substantially omni-directional.

Figure 9:
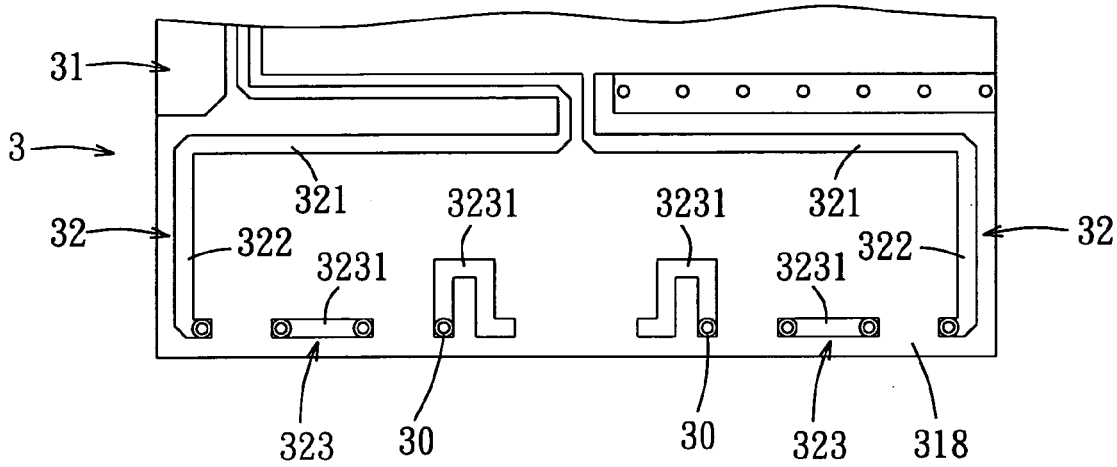
FIG. 9 is a schematic view of the second preferred embodiment of a dipole antenna according to the present invention.
Figure 10:
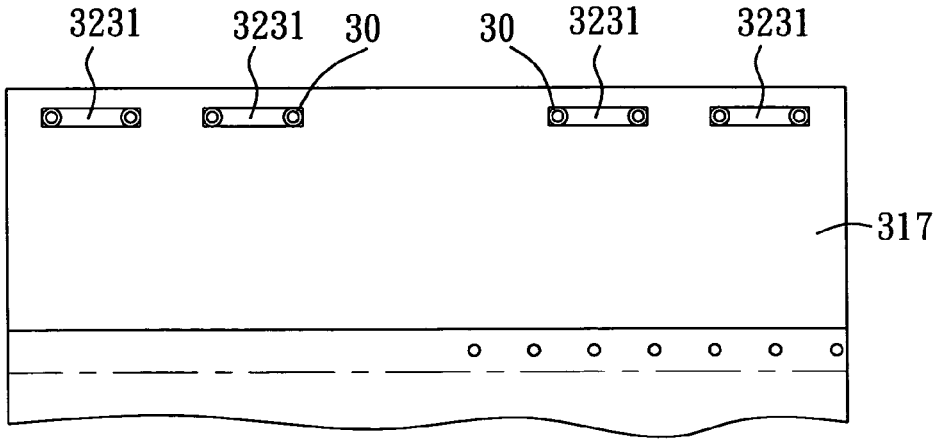
FIG. 10 is schematic view of the second preferred embodiment to illustrate segments of the dipole antenna of the present invention formed on a second surface of a dielectric substrate.
Figure 11:
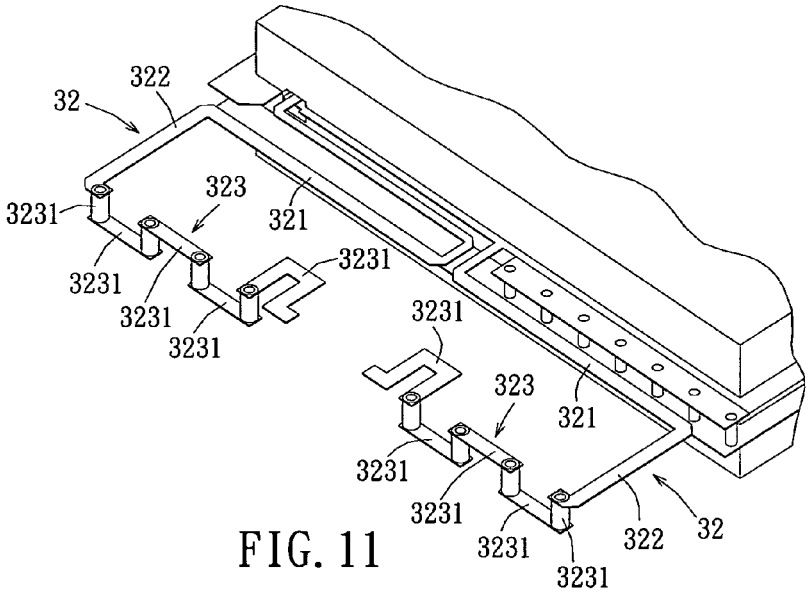
FIG. 11 is perspective view of the second preferred embodiment to illustrate segments of the dipole antenna of the present invention formed in holes in the dielectric substrate.

FIGS. 9 to 11 illustrate the second preferred embodiment of a dipole antenna according to the present invention. When compared to the previous embodiment, the dielectric substrate 31 further has a second surface 317 opposite to the first surface 318 in a third direction transverse to the first and second directions, and is further formed with a plurality of holes 30, each of which extends between the first and second surfaces 318, 317 of the dielectric substrate 31. Unlike the previous embodiment, the third strip 323 of each of the radiating arms 32 meanders between the first and second surfaces 318, 317 of the dielectric substrate 31 through the holes 30 in the dielectric substrate 31. That is, the third strip 323 of each of the radiating arms 32 has segments 3231 that are formed on the first and second surfaces 318, 317 of the dielectric substrate 31, and in the holes 30 in the dielectric substrate 31. The construction as such permits a reduction in the space occupied by the dipole element on the dielectric substrate 31.

Figure 12:
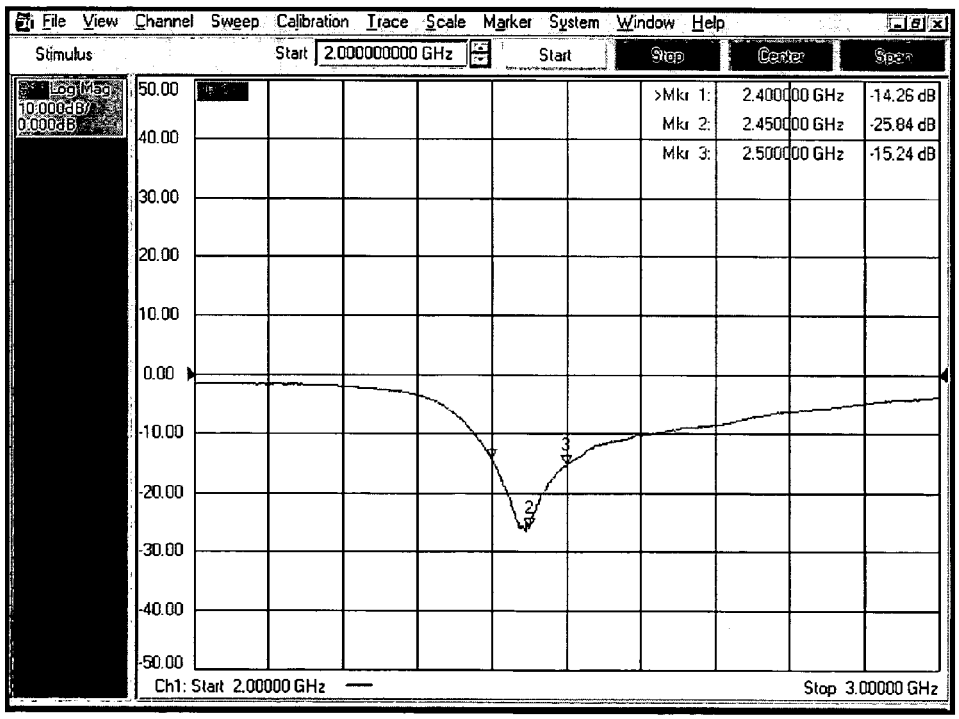
FIG. 12 is a graph illustrating a voltage standing wave ratio (VSWR) of the second preferred embodiment.
Figure 13:
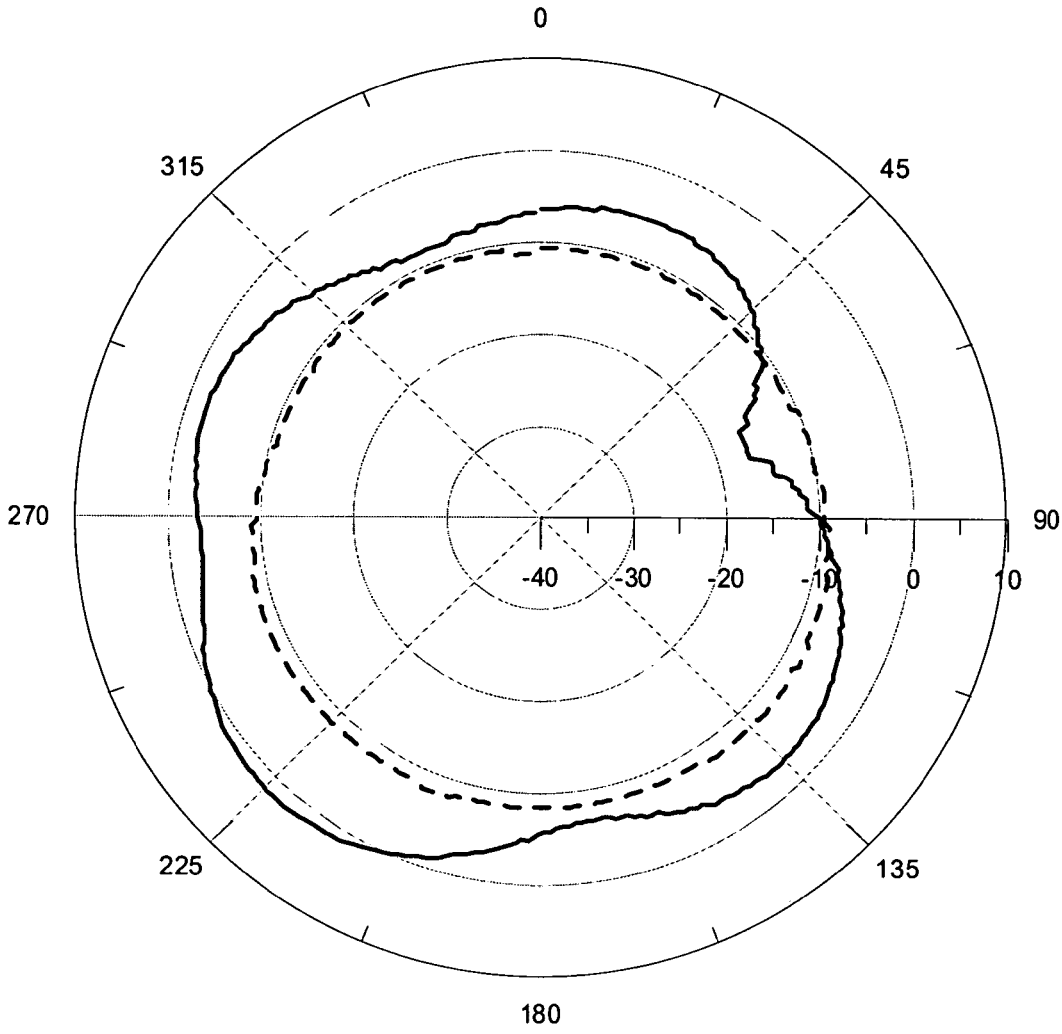
FIG. 13 is a graph illustrating a radiation pattern for horizontal and vertical polarization of the second preferred embodiment in the x-y plane.
Figure 14:
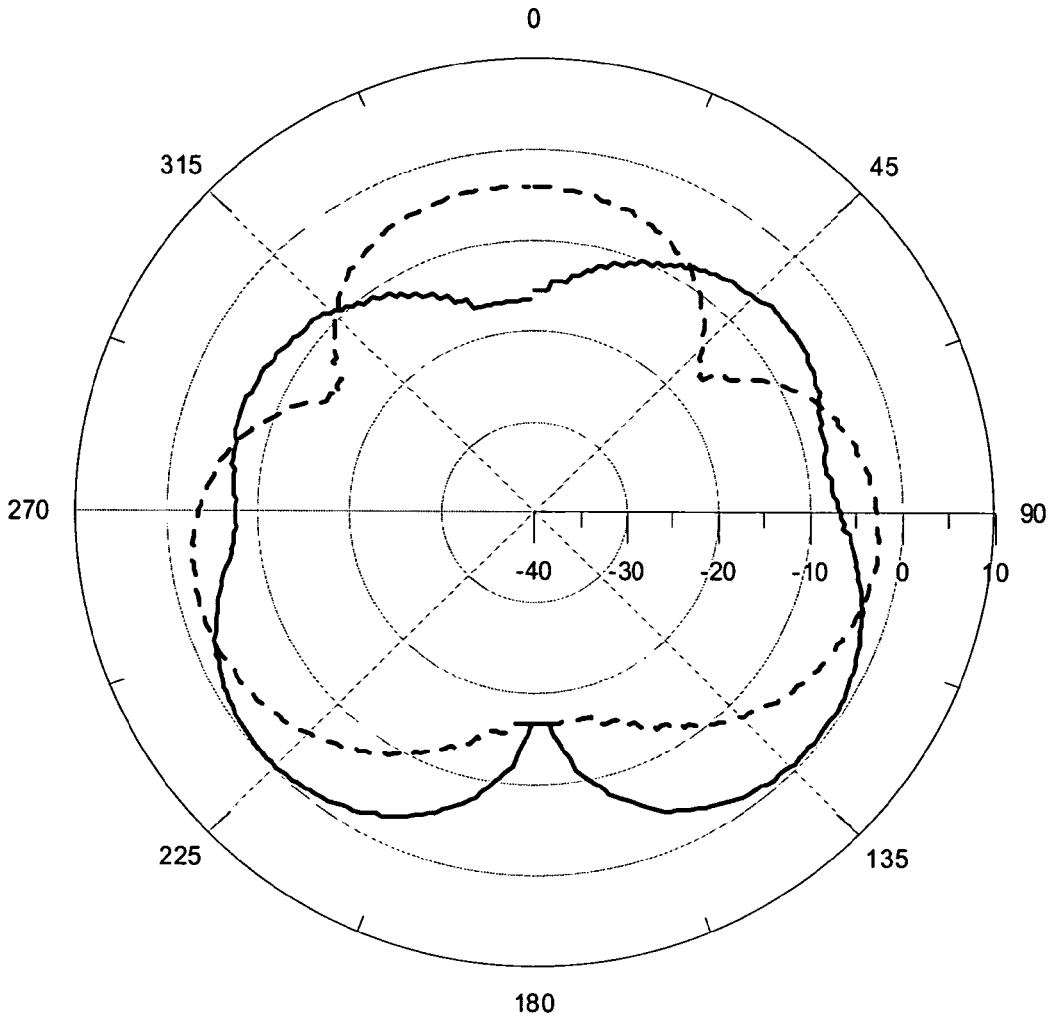
FIG. 14 is a graph illustrating a radiation pattern for horizontal and vertical polarization of the second preferred embodiment in the x-z plane.
Figure 15:
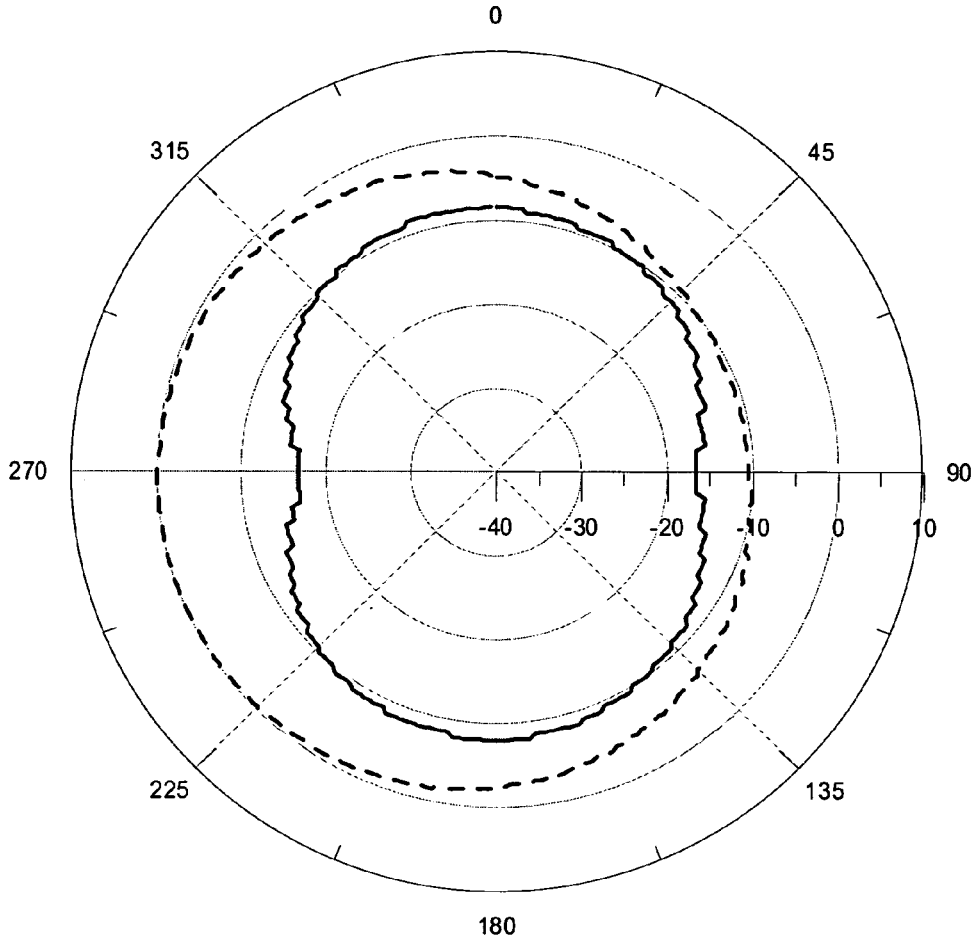
FIG. 15 is a graph illustrating a radiation pattern for horizontal and vertical polarization of the second preferred embodiment in the y-z plane.

From an experimental result, as illustrated in FIG. 12, at the given predetermined bandwidth, the dipole antenna of this invention has a relatively low voltage standing wave ratio (VSWR), i.e., less than 2. Moreover, as illustrated in FIG. 12, between the 2.37 MHz and 2.62 MHz bandwidth, the dipole antenna of this invention has a voltage standing wave ratio (VSWR) of less than 2 as well. Further, as illustrated in FIGS. 13 to 15, the radiation patterns for vertical polarization (broken line) and horizontal polarization (solid line) in x-y, x-z, and y-z planes of the dipole antenna of this invention are substantially omni-directional.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A dipole antenna comprising:

a board including a dielectric substrate; and a dipole element resonating within a predetermined bandwidth, said dipole element including pair of radiating arms, each of which is formed on said dielectric substrate, wherein each of said radiating arms includes:

a first strip that extends in a first direction, said first strip of each of said radiating arms having first and second ends that are respectively proximate to and distal from the other one of said radiating arms, said first ends of said first strips being adapted to be coupled to a transmission line, a second strip that extends in a second direction transverse to said first direction, said second strip of each of said radiating arms having a first end connected to said second end of said first strip of a respective one of said radiating arms, and a second end, and a third strip that extends in the first direction, said third strip of each of said radiating arms having first and second ends that are respectively proximate to and distal from the other one of said radiating arms, said first end of said third strip being connected to said second end of said second strip, wherein said dielectric substrate has a first surface, and a second surface opposite to said first surface in a third direction transverse to the first and second directions, said third strip of each of said radiating arms meandering between said first and second surfaces of said dielectric substrate through said dielectric substrate.

2. The dipole antenna as claimed in claim 1, wherein said radiating arms are bilaterally symmetrical.

3. The dipole antenna as claimed in claim 1, wherein said first strips of said radiating arms form a 180-degree angle therebetween.

4. The dipole antenna as claimed in claim 1, wherein said dielectric substrate of said board has a first surface, said dipole element being printed on said first surface of said dielectric substrate.

5. The dipole antenna as claimed in claim 4, wherein said first surface of said dielectric substrate of said board has an edge, said third strips of said radiating arms of said dipole antenna being disposed adjacent to said edge of said first surface of said dielectric substrate of said board.

6. The dipole antenna as claimed in claim 1, wherein said board is a printed circuit board.

7. A dipole antenna within a predetermined bandwidth that ranges between 2.36 MHz to 2.63 MHz, said dipole antenna comprising:

a board including a dielectric substrate that has a dielectric constant, which ranges between 4.2 to 4.7; and a dipole element resonating within the predetermined bandwidth, said dipole element being formed on said dielectric substrate, and including a pair of radiating arms, each of which has a length less than a quarter wavelength, wherein each of said radiating arms includes:

a first strip that extends in a first direction, said first strip of each of said radiating arms having first and second ends that are respectively proximate to and distal from the other one of said radiating arms, said first ends of said first strips being adapted to be coupled to a transmission line, a second strip that extends in a second direction transverse to said first direction, said second strip of each of said radiating arms having a first end connected to said second end of said first strip of a respective one of said radiating arms, and a second end, and a third strip that extends in the first direction, said third strip of each of said radiating arms having first and second ends that are respectively proximate to and distal from the other one of said radiating arms, said first end of said third strip being connected to said second end of said second strip, wherein said dielectric substrate has a first surface, and a second surface opposite to said first surface in a third direction transverse to the first and second directions, said third strip of each of said radiating arms meandering between said first and second surfaces of said dielectric substrate through said dielectric substrate.

8. The dipole antenna as claimed in claim 7, wherein said radiating arms are bilaterally symmetrical.

9. The dipole antenna as claimed in claim 7, wherein said first strips of said radiating arms form a 180-degree angle therebetween.

10. The dipole antenna as claimed in claim 7, wherein said dielectric substrate of said board has a first surface, said dipole element being printed on said first surface of said dielectric substrate.

11. The dipole antenna as claimed in claim 10, wherein said first surface of said dielectric substrate of said board has an edge, said third strips of said radiating arms of said dipole antenna being disposed adjacent to said edge of said first surface of said dielectric substrate of said board.

12. The dipole antenna as claimed in claim 7, wherein said board is a printed circuit board.

* * * * *